US010149593B2

(12) United States Patent
Boyer

(10) Patent No.: US 10,149,593 B2
(45) Date of Patent: Dec. 11, 2018

(54) SPRAY ARM ASSEMBLY FOR DISHWASHER APPLIANCE

(71) Applicant: Haier US Appliance Solutions, Inc., Wilmington, DE (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/287,780

(22) Filed: Oct. 7, 2016

(65) Prior Publication Data

US 2018/0098680 A1 Apr. 12, 2018

(51) Int. Cl.

| | |
|---|---|
| ***A47L 15/23*** | (2006.01) |
| ***A47L 15/42*** | (2006.01) |
| ***A47L 15/50*** | (2006.01) |

(52) U.S. Cl.

CPC ..... *A47L 15/23* (2013.01); *A47L 15/4259* (2013.01); *A47L 15/4261* (2013.01); *A47L 15/4293* (2013.01); *A47L 15/507* (2013.01)

(58) Field of Classification Search

CPC ..... A47L 15/22; A47L 15/23; A47L 15/00–15/508

See application file for complete search history.

(56) References Cited

U.S. PATENT DOCUMENTS

| | | | | |
|---|---|---|---|---|
| 3,876,148 | A | 4/1975 | Cushing et al. | |
| 6,325,083 | B1 * | 12/2001 | Worter | A47L 15/23 134/176 |
| 6,959,881 | B2 | 11/2005 | Kim | |
| 2009/0145981 | A1 * | 6/2009 | Mack | A47L 15/23 239/261 |
| 2012/0111380 | A1 | 5/2012 | Bayer et al. | |
| 2014/0069462 | A1 | 3/2014 | Becker et al. | |
| 2015/0000708 | A1 | 1/2015 | Welch | |
| 2015/0359408 | A1 | 12/2015 | Boyer et al. | |

FOREIGN PATENT DOCUMENTS

| | | | |
|---|---|---|---|
| EP | 1050263 | A2 | 11/2000 |
| JP | H10117993 | A | 5/1998 |

* cited by examiner

*Primary Examiner* — Spencer E Bell
(74) *Attorney, Agent, or Firm* — Dority & Manning, P.A.

(57) ABSTRACT

A spray arm assembly includes a spray arm including a plurality of branches connected to each other and arrayed about a center point, each of the plurality of branches defining a passage therethrough and an aperture in fluid communication with the passage. The center point defines a spray arm central axis. The spray arm is rotatable about the spray arm central axis. The spray arm assembly further includes a base conduit defining a passage therethrough, the base conduit defining a base conduit central axis. The base conduit central axis is offset from the spray arm central axis. The spray arm assembly further includes an intermediate conduit connecting the base conduit and the spray arm, the intermediate conduit defining a passage in fluid communication between the passage of the base conduit and the passages of the plurality of branches. The intermediate conduit is rotatable about the base conduit central axis.

20 Claims, 8 Drawing Sheets

SPRAY ARM ASSEMBLY FOR DISHWASHER APPLIANCE

FIELD OF THE INVENTION

The present disclosure relates generally to dishwasher appliances, and more particularly to improved spray arm assemblies for dishwasher appliances.

BACKGROUND OF THE INVENTION

Dishwasher appliances generally include a tub that defines a wash compartment. Rack assemblies can be mounted within the wash compartment of the tub for receipt of articles for washing. During wash and rinse cycles, spray assemblies within the wash compartment can apply or direct wash fluid (e.g. various combinations of water and detergent along with optional additives) towards articles disposed within the rack assemblies in order to clean such articles.

Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

One limitation of many currently known spray arm assemblies is the geometry of the spray arm assemblies relative to the geometry of the dishwasher appliance interior. Most known spray arm assemblies utilize a generally circular geometry. For example, an arm of a spray arm assembly may rotate in a circle, and jets or apertures defined in the arm may emit wash fluid from the arm in this circular pattern. However, the cross-sectional interior geometry of most currently known dishwasher appliances is square or rectangular. Accordingly, the corners of such dishwasher appliance, and the articles located therein, may not be sufficiently reached by wash fluid. This can result in these articles not being properly cleaned during operation of the dishwasher appliance.

Attempts have been made to provide sufficient wash fluid in the corners of dishwasher appliances. For example, various jets may be angled towards the outer periphery of a dishwasher appliance interior, in an attempt to direct wash fluid towards the corners. Such designs, however, are typically inefficient, requiring dedicated wash fluid streams which are only effective within minimal windows. Other attempts have utilized pivoting supports or outer peripheral tracks to guide the spray arm assemblies. Such designs, however, are typically complex, expensive, and ineffective.

More recently, attempts have been made to utilize various cantilevered spray arm component designs. However, these designs are subject to considerable stresses due to the various reactionary forces from the weights of the spray arm components and the liquid being flowed therethrough.

Accordingly, improved dishwasher appliances and associated spray arm assemblies are desired in the art. In particular, improved spray arm assembly designs which provide sufficient wash fluid flow to the outer peripheral areas, and particularly the corners thereof, of dishwasher appliances would be advantageous. Further, improved spray arm assembly designs which minimize stresses and potential binding of rotating components during operation would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a spray arm assembly for a dishwasher appliance is disclosed. The spray arm assembly includes a spray arm including a plurality of branches connected to each other and arrayed about a center point, each of the plurality of branches defining a passage therethrough and an aperture in fluid communication with the passage. The center point defines a spray arm central axis. The spray arm is rotatable about the spray arm central axis. The spray arm assembly further includes a base conduit defining a passage therethrough, the base conduit defining a base conduit central axis. The base conduit central axis is offset from the spray arm central axis. The spray arm assembly further includes an intermediate conduit connecting the base conduit and the spray arm, the intermediate conduit defining a passage in fluid communication between the passage of the base conduit and the passages of the plurality of branches. The intermediate conduit is rotatable about the base conduit central axis. The intermediate conduit includes a first collar that defines a first opening and a second collar that defines a second opening, the first opening providing the fluid communication between the passage of the intermediate conduit and the passage of the base conduit, the second opening providing the fluid communication between the passage of the intermediate conduit and the passages of the plurality of branches. The spray arm assembly further includes a gear assembly at least partially disposed within the intermediate conduit. The gear assembly includes a first gear rotatable about the base conduit central axis and a second gear rotatable about the spray arm central axis. The gear assembly further includes a first hollow bearing extending from the first gear through the first opening and a second hollow bearing extending from the second gear through the second opening. A radial clearance of between about 0.005 inches and about 0.020 inches is defined between the first hollow bearing and the first collar and between the second hollow bearing and the second collar.

In accordance with one embodiment of the present disclosure, a spray arm assembly for a dishwasher appliance is disclosed. The spray arm assembly includes a spray arm including a plurality of branches connected to each other and arrayed about a center point, each of the plurality of branches defining a passage therethrough and an aperture in fluid communication with the passage. The center point defines a spray arm central axis. The spray arm is rotatable about the spray arm central axis. The spray arm assembly further includes a base conduit defining a passage therethrough, the base conduit defining a base conduit central axis. The base conduit central axis is offset from the spray arm central axis. The spray arm assembly further includes an intermediate conduit connecting the base conduit and the spray arm, the intermediate conduit defining a passage in fluid communication between the passage of the base conduit and the passages of the plurality of branches. The intermediate conduit is rotatable about the base conduit central axis. The intermediate conduit comprising an upper casing portion and a lower casing portion. The spray arm assembly further includes a gear assembly at least partially disposed within the intermediate conduit. The gear assembly includes a first gear rotatable about the base conduit central axis and a second gear rotatable about the spray arm central axis. The gear assembly further includes a first solid bearing disposed between the first gear and the lower casing portion and a second solid bearing disposed between the second gear and the upper casing portion. The first solid bearing and second solid bearing each include a body and a support post extending from the body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
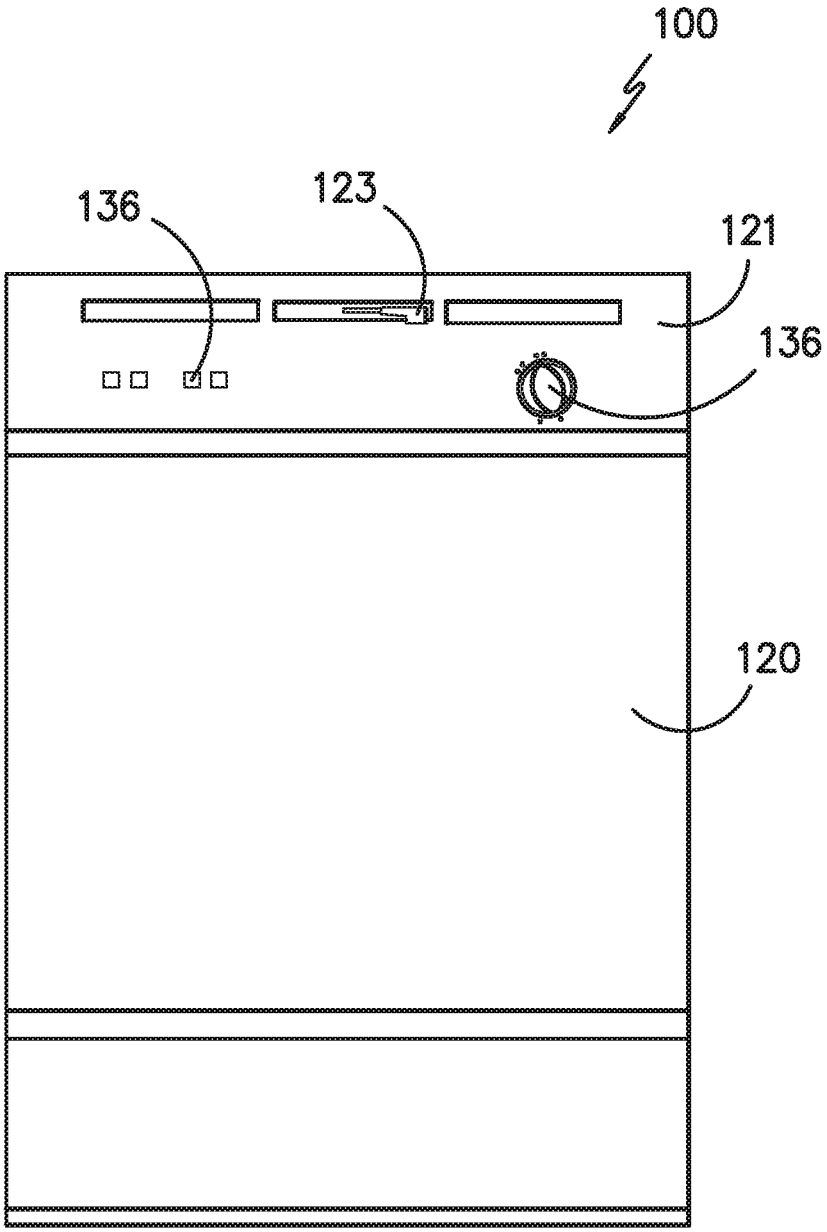
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time in which the dishwashing appliance operates to remove residual soil, detergents, and other undesirable elements that were retained by the articles after completion of the wash cycle. The term "wash fluid" refers to a liquid used for washing and/or rinsing the articles and is typically made up of water that may include other additives such as detergent or other treatments.

Figure 2:
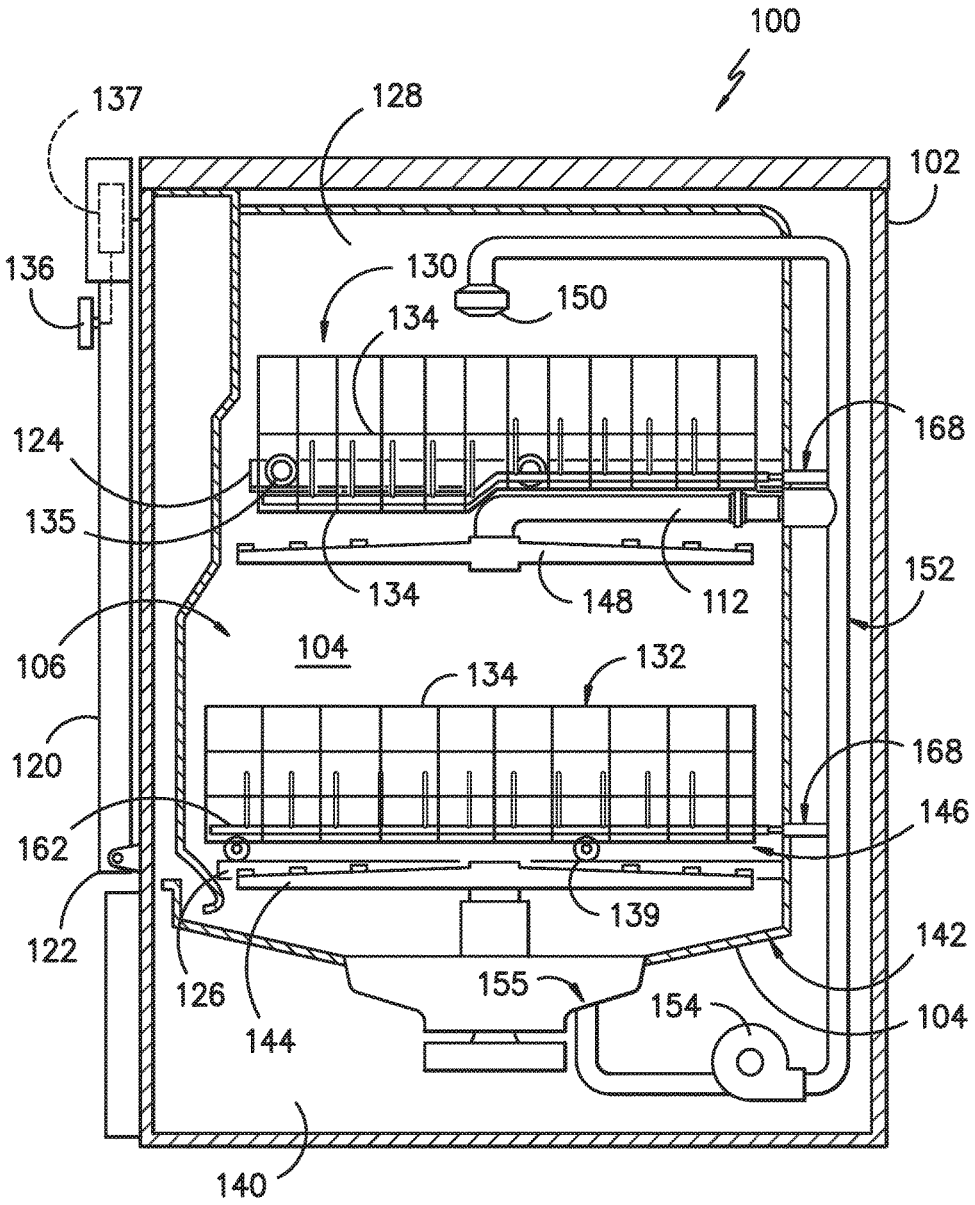
FIG. 2 is a cross-sectional view of a dishwasher appliance in accordance with one embodiment of the present disclosure.
Figure 3:
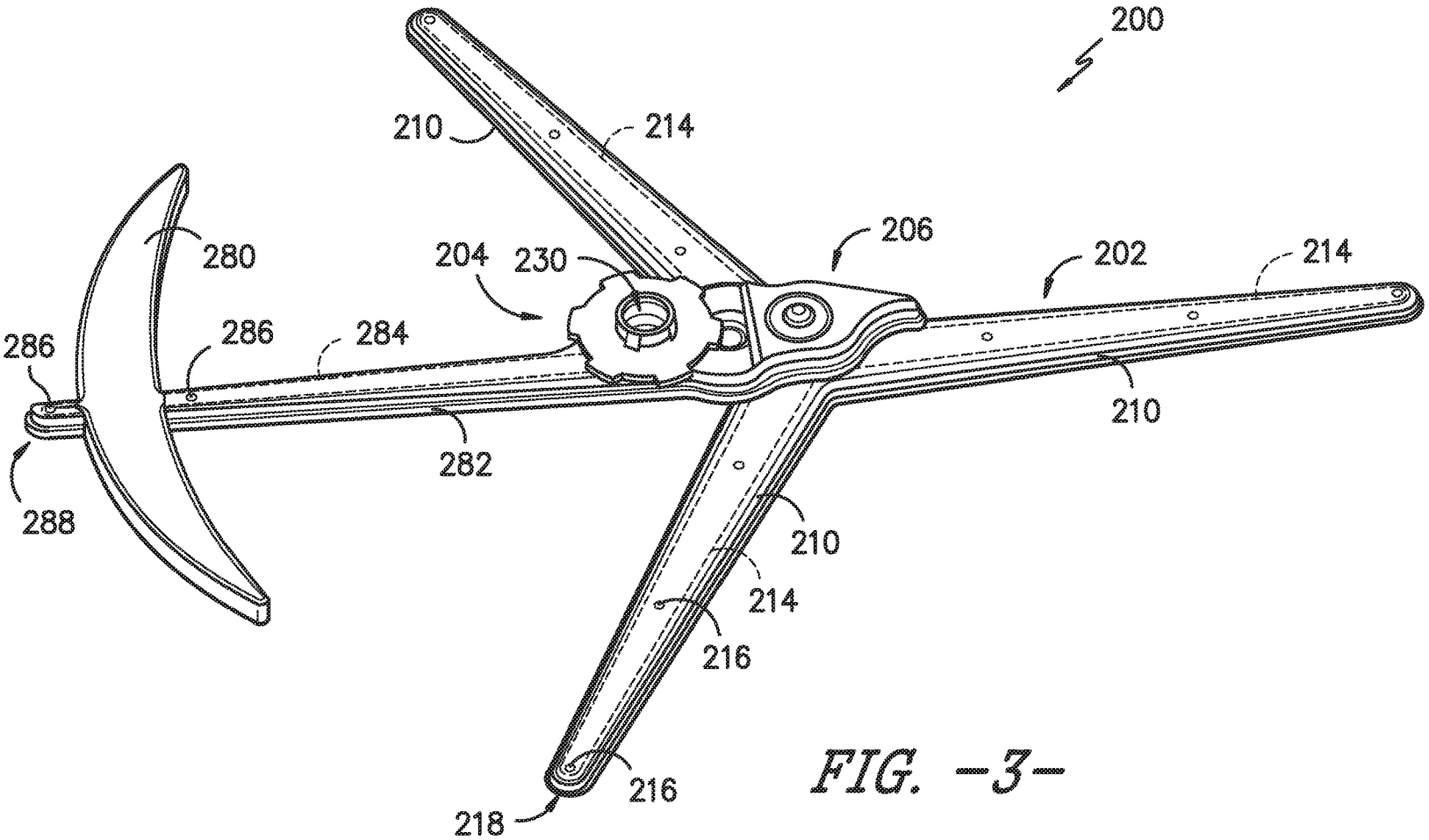
FIG. 3 is a top perspective view of a spray arm assembly in accordance with one embodiment of the present disclosure.
Figure 4:
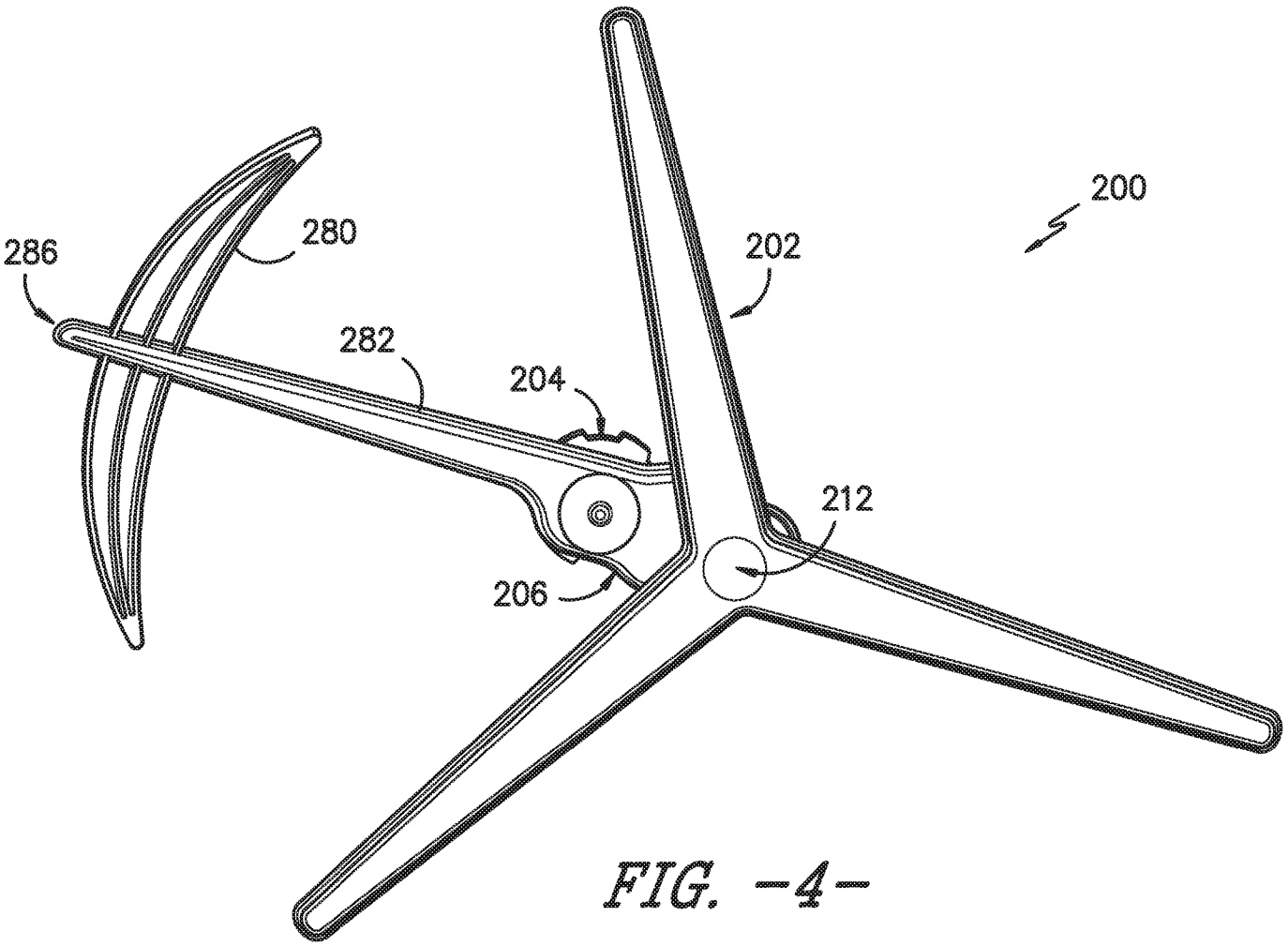
FIG. 4 is a bottom view of a spray arm assembly in accordance with one embodiment of the present disclosure.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports, also referred to as jets or apertures, in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and one or more microprocessors, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Referring now to FIGS. 3 through 8, various embodiments of a spray arm assembly 200 are illustrated. A spray arm assembly 200 may be utilized in a dishwasher appliance 100, and advantageously may provide sufficient wash fluid flow to the outer peripheral areas, and particularly the corners thereof, of the dishwasher appliance 100. In particular, the rotational pattern of the spray arm assembly 200 generally and the branches and apertures thereof, as discussed herein, may efficiently and reliably provide wash fluid flow to the outer peripheral areas of the dishwasher appliance 100.

In exemplary embodiments, the spray arm assembly 200 is a mid-level spray arm assembly 148. Alternatively, the spray arm assembly 200 may be a lower spray arm assembly 144 or may be utilized in the place of an upper spray assembly 150, or may be utilized in any other suitable position within dishwasher appliance 100. The spray arm assembly 200 may generally be in fluid communication with the fluid circulation assembly 152 to receive wash fluid therefrom. The wash fluid is then flowed through the spray arm assembly 200 and exhausted therefrom into the wash chamber 106 during operation of the dishwasher appliance 100, such as during a wash or rinse cycle.

Spray arm assembly 200 includes a spray arm 202, a base conduit 204, and an intermediate conduit 206 connecting the base conduit 204 and spray arm 202. The base conduit 204 may be in fluid communication with the fluid circulation assembly 152 to receive wash fluid therefrom. This wash fluid may flow from the base conduit 204 through the intermediate conduit 206 to the spray arm 202. Further, as discussed, the spray arm 202 may be rotatable about a central axis relative to the intermediate conduit 206, and the intermediate conduit 206 may be rotatable about a central axis relative to the base conduit 205. The respective central axes may be generally parallel and offset from each other, such that a travel path for branches of the spray arm 202 provides wash fluid to the outer periphery of the wash chamber 106. For example, in exemplary embodiments, the tips of each branch may generally form a Reuleaux triangle.

Spray arm 202 may include, for example, a plurality of branches 210. The branches 210 may be connected to each other and arrayed about a center point 212, as illustrated. Each branch 210 may define a passage 214 therethrough. Further, each branch 210 may define one or more apertures 216. Apertures 216 of a branch 210 may be in fluid communication with the passage 214 of that branch 210, such that wash fluid may flow from the passage 214 through the apertures 216 to the wash chamber 106.

In exemplary embodiments as illustrated, spray arm 202 may include three branches 210. These branches 210 may be equidistantly arrayed about the center point 212, which in the case of three branches 210 equates to 120 degrees apart. Apertures 216 may be spaced apart along the length of each branch 210. Further, in exemplary embodiments, at least one aperture 216 may be defined proximate a tip 218 of each branch 210. The tip 218 may be the farthest point on the branch 210 from the center point 212.

Center point 212 of the spray arm 202 may define a spray arm central axis 220. The axis 220 may extend through the center point 212 perpendicularly to a plane defined by the branches 210. The spray arm 202 may be rotatable about this axis 220.

Base conduit 204 may also define a passage 230 therethrough. Wash fluid may flow into the passage 230 from the fluid circulation assembly 152, and from the passage 230 to the intermediate conduit 206. Further, base conduit 204 may, as illustrated, define a base conduit central axis 232. In some embodiments, as illustrated, the base conduit central axis 232 may extend through a center point of the base conduit 204. The base conduit central axis 232 may extend generally parallel to the spray arm central axis 220. Further, advantageously, the spray arm central axis 220 may be offset from the base conduit central axis 232.

Intermediate conduit 206 may further define a passage 240 therethrough. The passage 240 may be in fluid communication between the passage 230 and the passages 214, such that wash fluid flowed to passage 230 can flow through passage 240 to passages 214. The intermediate conduit 206 may be rotatable about the base conduit central axis 232.

In exemplary embodiments, the intermediate conduit 206 may include an upper casing portion 242 and a lower casing portion 244, which may together define therebetween the passage 240. As shown, the upper and lower casing portions 242, 244 may be separate components which are connected together to form and define the intermediate conduit 206. Alternatively, the upper and lower casing portions 242, 244 may be integral, and thus integrally formed as a singular, unitary component. As discussed in further detail herein, in some embodiments, a pocket 243 may be defined in the upper casing portion and a pocket 245 may be defined in the lower casing portion 245. These pockets 243, 245 may advantageously accommodate bearings of a gear assembly of the spray arm assembly 200 as discussed herein. Notably, pocket 243 may in exemplary embodiments be coaxial with the spray arm central axis 220 such that central axis 220 extends through a centerpoint of the pocket 243, and pocket 245 may in exemplary embodiments be coaxial with the base conduit central axis 232 such that central axis 232 extends through a centerpoint of the pocket 245.

Intermediate conduit 206 may further include a first collar 300 and a second collar 310. The first collar 300 may, for example, be connected to or an integral component of the upper casing portion 242. Further, in exemplary embodiments, the first collar 300 may be coaxial with the base conduit central axis 232 such that central axis 232 extends through a centerpoint of the first collar 300. The second collar 310 may, for example, be connected to or an integral component of the lower casing portion 244. Further, in exemplary embodiments, the second collar 310 may be coaxial with the spray arm central axis 220 such that central axis 220 extends through a centerpoint of the second collar 310.

The first collar 300 may define a first opening 302 of the intermediate conduit 206. Such first opening 302 may provide the fluid communication between the passage 240 and the passage 230. Fluid may thus flow from passage 230 through first opening 302 into passage 240. The second collar 310 may define a second opening 312 of the intermediate conduit 206. Such second opening 312 may provide the fluid communication between the passage 240 and the passages 214. Fluid may thus flow from passage 240 through second opening 312 into passages 214.

The first and second collars 300, 310 may each have a stepped configuration. For example, as shown, each collar 300, 310 may include a first inner sidewall 304, 314, respectively, and a second inner sidewall 306, 316, respectively. A diameter 307 (such as a maximum diameter) of the second inner sidewall 306 may be less than a diameter 305 (such as a maximum diameter) of the first inner sidewall 304. A diameter 317 (such as a maximum diameter) of the second inner sidewall 316 may be less than a diameter 315 (such as a maximum diameter) of the first inner sidewall 314. A step 308, 318, which as shown may be a radially-extending inner surface, may extend between each first inner sidewall 304, 314 and associated second inner sidewall 306, 316.

As discussed, during operation of the spray arm assembly 200, rotation of two separate components about offset parallel axes may occur. The intermediate conduit 206 may rotate about the base conduit central axis 232, and the spray arm 202 by rotate about the spray arm central axis 220, which may be offset from the base conduit central axis 232. Such rotations may result in an advantageous travel path for the branches 210 and the apertures 216 thereof. Such travel path may allow the tips 218 of the branches 210 to approach the periphery, and in particular the peripheral corners, of the wash chamber 106, such that wash fluid from the apertures 216 proximate the tips 218 can impart wash fluid to the corners and periphery.

Figure 9:
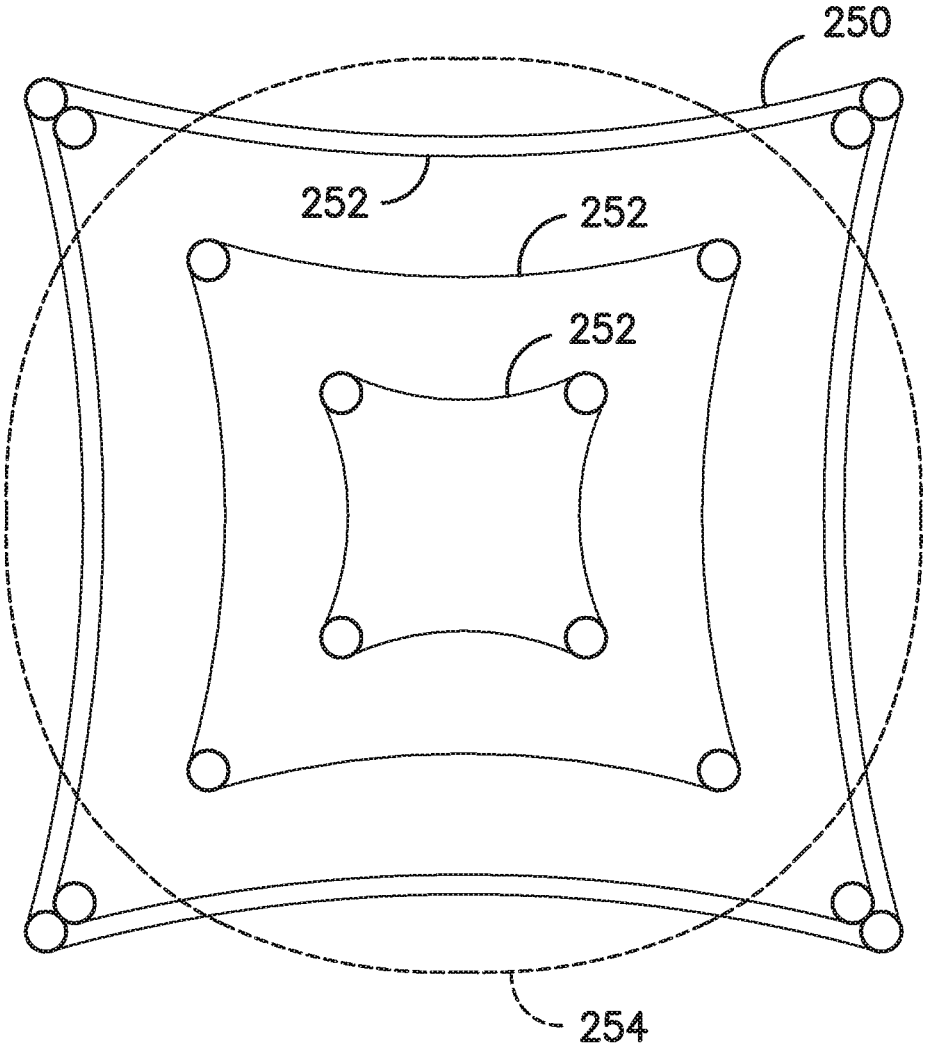
FIG. 9 is a diagram illustrating travels paths of branches of a spray arm of a spray arm assembly in accordance with one embodiment of the present disclosure.

In exemplary embodiments, the tips 218 of the branches 210 may generally form a Reuleaux triangle. In other words, the tips 218 and movement thereof may be generally constrained by the geometries of a Reuleaux triangle. Respective apertures 216 of the branches 210 may similarly form, and thus be constrained by the geometries of, Reuleaux triangles. FIG. 9 illustrates exemplary travels paths 250, 252 of tips 218 and apertures 216, along with a comparative ideal Reuleaux triangle travel path 254. The travels paths 250, 252 may approximate Reuleaux triangle travel paths 254, as shown, or follow Reuleaux triangle travel paths 254. It further follows that the tips 218 of the branches 210 in exemplary embodiments may be or approximate vertices of a Reuleaux triangle.

Notably, in exemplary embodiments, fluid flow through the spray arm assembly 200 may cause rotation of the spray arm 202 about the spray arm central axis 220 and rotation of the intermediate conduit 206 about the base conduit central axis 232. In these embodiments, no external forces, such as by a motor, etc., may cause such rotations. Alternatively, however, external forces from a motor or other suitable device may be applied, solely or in addition to the use of forces from the fluid flow, to cause such rotations.

In exemplary embodiments, as illustrated in FIGS. 5 through 8, spray arm assembly 200 may further include a gear assembly 260. The gear assembly 260 may facilitate the rotations of the spray arm assembly components 200 as discussed herein. As illustrated, gear assembly 260 may be disposed within the intermediate conduit 206. Gear assembly 260 may include, for example, a first gear 262 rotatable about the base conduit central axis 232. The axis 232 may for example extend through a centerpoint of the first gear 262, such that a central axis of the first gear 262 is coaxial with the axis 232. Gear assembly 260 may further include, for example, a second gear 264 rotatable about the spray arm central axis 220. The axis 220 may for example extend through a centerpoint of the second gear 264, such that a central axis of the second gear 264 is coaxial with the axis 220. In exemplary embodiments, the gear assembly 260 may further include a third gear 266 rotatably connecting the first gear 262 and the second gear 264. Accordingly, teeth of the third gear 266 may mesh with teeth of the first and second gears 262, 264, such that rotation of one gear causes rotation of the other two. In alternative embodiments, the first gear 262 and second gear 264 may be rotatably connected, with no intervening gear, or additional gears may be utilized between the first gear 262 and second gear 264.

In exemplary embodiments, a gear ratio between the first gear 262 and the second gear 264 is approximately 1 to −0.75. Such ratio may facilitate the advantageous movement of the branches 210, and the tips 218 and apertures 216 thereof, as discussed herein. For example, when a third gear 266 is utilized, a gear ratio between the first gear 262 and the third gear 266 may be approximately 1 to 1, and a gear ration between the third gear 266 and the second gear 264 may be approximately 1 to 0.75. Alternatively, however, any suitable gear ratios between any of the gears of gear assembly 260 may be utilized.

Figure 5:
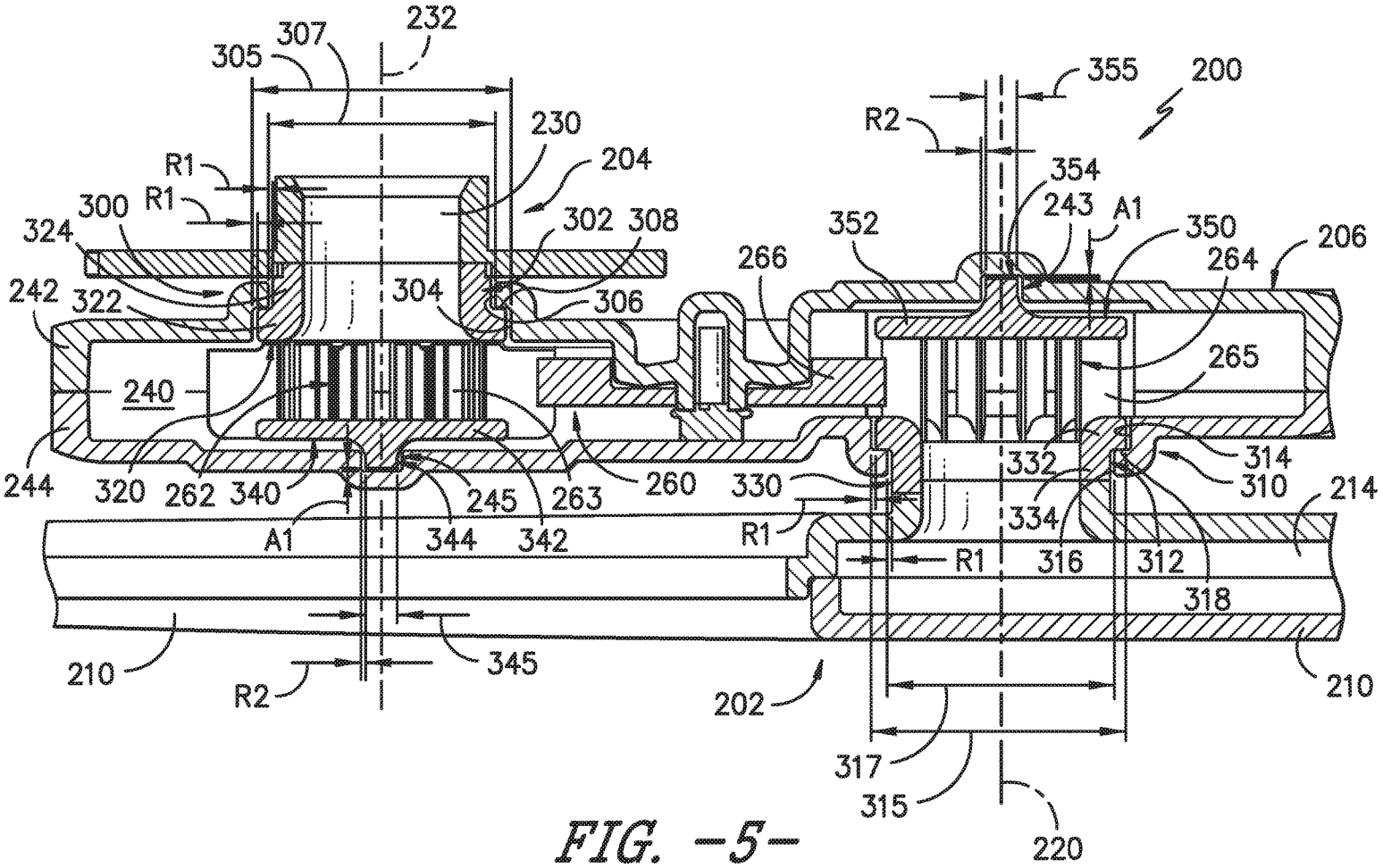
FIG. 5 is a cross-sectional view of a portion of a spray arm assembly in accordance with one embodiment of the present disclosure.
Figure 6:
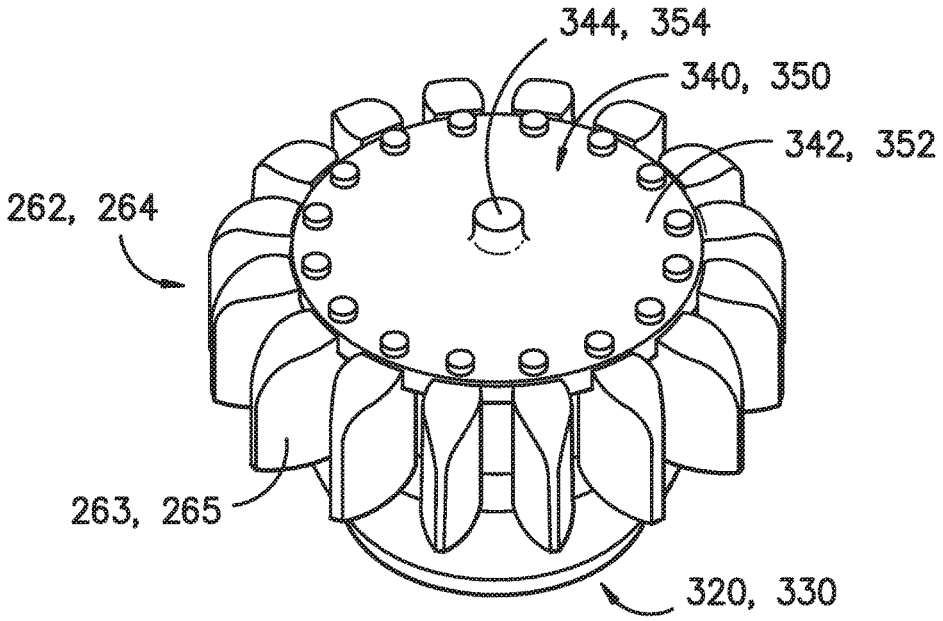
FIG. 6 is a perspective view of a gear, hollow bearing and solid bearing in accordance with one embodiment of the present disclosure.
Figure 7:
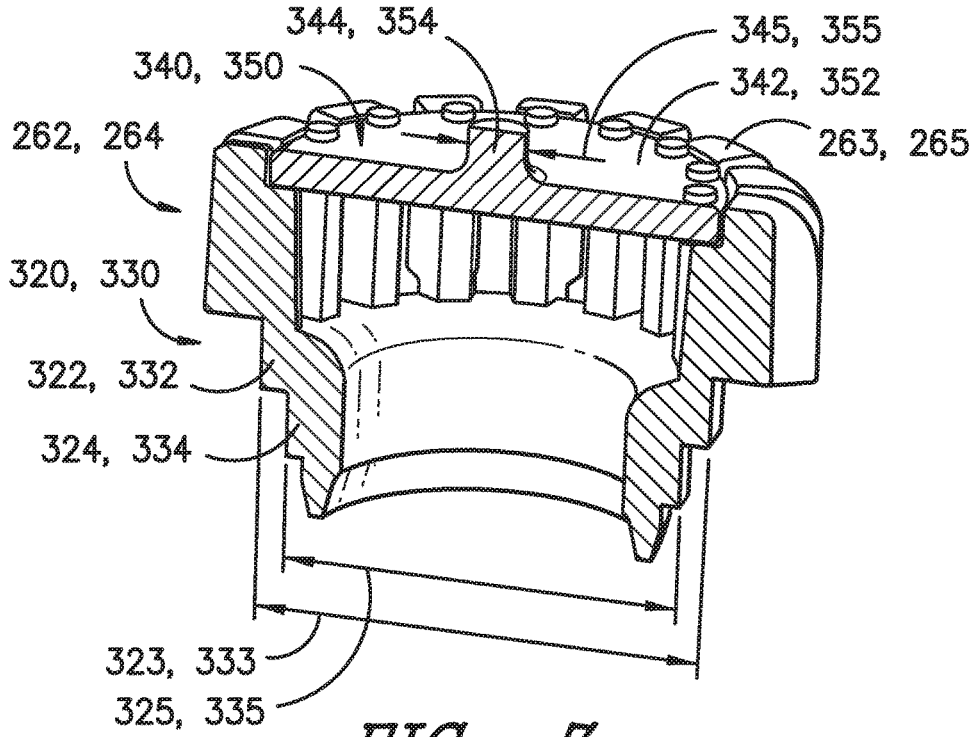
FIG. 7 is a perspective cross-sectional view of a gear, hollow bearing and solid bearing in accordance with one embodiment of the present disclosure.

As further illustrated in FIG. 5, in exemplary embodiments, the first gear 262 and second gear 264 are generally hollow. For example, as illustrated, the central portions of such gears may be hollow, and openings may be defined between the teeth of the gears. This advantageously allows for the flow of wash fluid through these gears, i.e. from the central portion through the openings between the teeth or vice versa, which allows for the rotations of the various components of the spray arm assembly 200 as discussed herein and reduces or prevents binding. Wash fluid may thus, for example, flow through first gear 262 from the passage 230, and through second gear 264 to the passages 214. For example, wash fluid may be free to flow into the first gear 262 from the passage 230 of the base conduit 204 (such as in a direction along the base conduit central axis 232), out of the first gear 262 in a generally radial direction between the teeth thereof, into the second gear 264 in a generally radial direction between the teeth thereof, and from the second gear 264 into the passages 214 of the spray arm 202.

The first gear 262 may generally be fixedly connected to the base conduit 204, and the second gear 264 may generally be fixedly connected to the spray arm 202. Since the base conduit 204 is generally fixed to the fluid circulation assembly 152, rotation of the gear assembly 260 may thus cause rotation of the spray arm 202 and the intermediate conduit 206 as discussed herein.

For example, bearings may be provided which fixedly connect the first gear 262 to the base conduit 204 and the second gear 264 to the spray arm 202. As shown, gear assembly 260 may include a first hollow bearing 320 and a second hollow bearing 330. First hollow bearing 320 may be fixedly connected to the first gear 262, and may extend from the first gear 262 axially through the first opening 302 to the base conduit 204. As shown, the first hollow bearing 320 may, for example, be coaxial with the axis 232. The first hollow bearing 320 may further be fixedly connected to the base conduit 204. In exemplary embodiments, first hollow bearing 320 may be integral, and thus integrally formed as a single, unitary component, with first gear 262. Alternatively, however, first hollow bearing 320 may be a separate component that is connected to the first gear 262. Second hollow bearing 330 may be fixedly connected to the second gear 264, and may extend from the second gear 264 axially through the second opening 312 to the spray arm 202. The second hollow bearing 330 may further be fixedly connected to the spray arm 202. As shown, the second hollow bearing 330 may, for example, be coaxial with the axis 220. In exemplary embodiments, second hollow bearing 330 may be integral, and thus integrally formed as a single, unitary component, with second gear 264. Alternatively, however, second hollow bearing 330 may be a separate component that is connected to the second gear 264.

In exemplary embodiments, each hollow bearing 320, 330 may include a body 322, 332 and a flange 324, 334 which extends from the body 322, 332. A diameter 325, 335 (such as a maximum diameter defined by the outer surface of the flange 324, 334) of each flange 324, 334 may be less than a diameter 323, 333 (such as a maximum diameter defined by the outer surface of the body 322, 332) of the associated body 322, 332.

In exemplary embodiments, particular clearances may be defined between the hollow bearings 320, 330 and associated collars 300, 310. Such clearances may advantageously minimize stresses and potential binding in the spray arm assembly 200 during use. The clearances are advantageously sufficiently large to minimize stresses and potential binding, but sufficiently small to prevent excess movement of the bearings 320, 330 and gears 262, 264 which could cause damage thereto. The clearances account for stresses due to the various reactionary forces from the weights of the spray arm components and the liquid being flowed therethrough.

For example, in exemplary embodiments, a radial (i.e. perpendicular to associated axis 220 or 232) clearance of between about 0.005 inches and about 0.020 inches, such as between about 0.010 inches and 0.015 inches, such as about 0.010 inches, such as 0.010 inches, is defined between the first hollow bearing 320 and the first collar 300 and between the second hollow bearing 320 and the second collar 310. The term "about", as utilized herein, means within a tolerance of plus or minus 0.005 inches. Such clearance is defined, as shown, between an inner surface of the collar and a neighboring outer surface of the hollow bearing. More specifically, in exemplary embodiments, such radial clearance R1 of between about 0.005 inches and about 0.020 inches, such as between about 0.010 inches and 0.015 inches, such as about 0.010 inches, such as 0.010 inches, may be defined between each body 322, 332 and associated second inner sidewall 306, 316 and between each flange 324, 334 and associated first inner sidewall 304, 314.

In exemplary embodiments, gear assembly 260 may further include additional solid bearings disposed between the gears and the casing portions of the intermediate conduit 206. For example, a first solid bearing 340 may be disposed between the first gear 262 and the lower casing portion 244, and a second solid bearing 350 may be disposed between the second gear 264 and the upper casing portion 242. These bearings 340, 350 may further facilitate rotation of the gear assembly and reduce or eliminate binding during operation thereof.

First solid bearing 340 may be fixedly connected to the first gear 262. Further, as shown, first solid bearing 340 may be coaxial with axis 232. First solid bearing 340 may be integral, and thus integrally formed as a single, unitary component, with first gear 262, or, as shown, may be a separate component that is connected to the first gear 262. Second solid bearing 350 may be fixedly connected to the second gear 264. Further, as shown, second solid bearing 350 may be coaxial with axis 220. Second solid bearing 350 may be integral, and thus integrally formed as a single, unitary component, with second gear 264, or, as shown, may be a separate component that is connected to the second gear 264.

In exemplary embodiments as shown, the first solid bearing 340 and second solid bearing 350 may each include a body 342, 352 and a support post 344, 354 extending from the associated body 342, 352, such as along the axial direction. Each support port 344, 354 may extend into the associated pocket 245, 243 of the associated casing portion 242, 244.

In exemplary embodiments, particular clearances and sizes may be defined for the solid bearings 340, 350, and in particular the support posts 344, 354 thereof, relative to the associated pocket 245, 243 of the associated casing portion 242, 244. Such clearances may advantageously minimize stresses and potential binding in the spray arm assembly 200 during use. The clearances are advantageously sufficiently large to minimize stresses and potential binding, but sufficiently small to prevent excess movement of the bearings 340, 350 and gears 262, 264 which could cause damage thereto. The clearances account for stresses due to the various reactionary forces from the weights of the spray arm components and the liquid being flowed therethrough.

For example, in some exemplary embodiments, each support post 344, 354 may have a diameter 345, 355 (such as a maximum diameter) of between 0.1 inches and 0.15 inches, such as between 0.11 inches and 0.13 inches, such as between 0.115 inches and 0.125 inches, such as 0.12 inches. Additionally or alternatively, a radial (i.e. perpendicular to associated axis 220 or 232) clearance R2 of between about 0.005 inches and about 0.020 inches, such as between about 0.010 inches and 0.015 inches, such as about 0.010 inches, such as 0.010 inches, is defined between the support post 344 and the pocket 245 and between the support post 354 and the pocket 243. Such clearance is defined, as shown, between an inner surface of the pocket and a neighboring outer surface of the support post. Additionally or alternatively, an axial (i.e. parallel to associated axis 220 or 232) clearance A1 of between about 0.005 inches and about 0.020 inches, such as between about 0.010 inches and 0.015 inches, such as about 0.010 inches, such as 0.010 inches, is defined between the support post 344 and the pocket 245 and between the support post 354 and the pocket 243. Such clearance is defined, as shown, between an inner surface of the pocket and a neighboring outer surface of the support post.

In exemplary embodiments, the gears 262, 264, hollow bearings 320, 330, and solid bearings 340, 350 are formed from suitable plastics, such as acetals. Alternatively, however, other suitable materials may be utilized.

Figure 8:
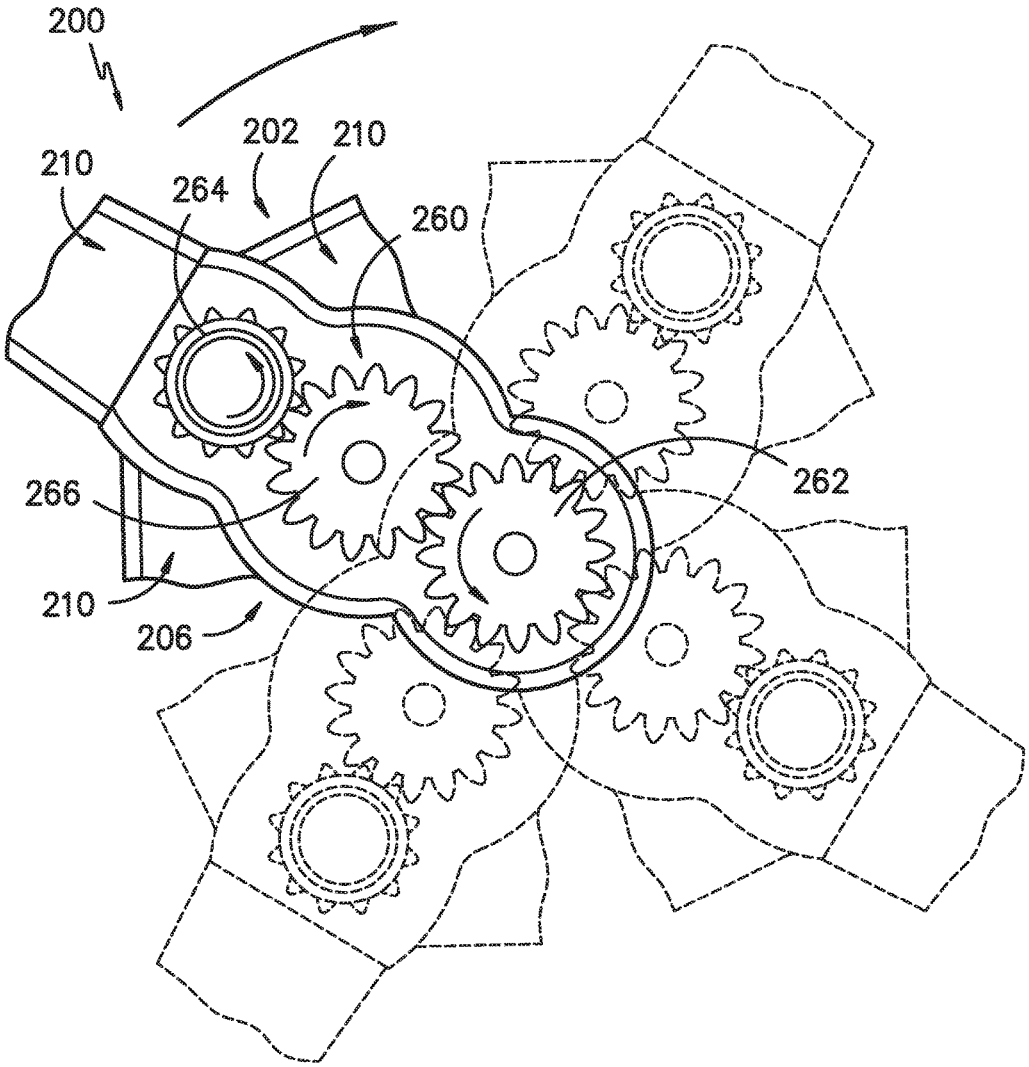
FIG. 8 is a top view of a gear assembly for use with a spray arm assembly, along with contextual transparent portions of the spray arm assembly, illustrating movement of the gear assembly and spray arm assembly in accordance with one embodiment of the present disclosure.

FIG. 8 illustrates movement of the gear assembly 260 during operation of the spray arm assembly 200 and dishwasher appliance 100 generally. Rotational directions of the gears 262, 264, 266 are illustrated, along with rotation of the spray arm 202 about the spray arm central axis 220 and rotation of the intermediate conduit 206 about the base conduit central axis 232. (Only portions of the spray arm 202 and intermediate conduit 206 are illustrated, for illustrative purposes only.)

Referring again to FIGS. 3 and 4, in some embodiments, spray arm assembly 200 may further include a counterweight 280. The counterweight 280 may balance the spray arm assembly 200, particularly during rotation of both the spray arm 202 and the intermediate conduit 206 about the offset axes 220, 232, respectively. In exemplary embodiments as illustrated, counterweight 280 may be generally arcuate. The counterweight 280 may be connected to the intermediate conduit 206, such as to an auxiliary arm 282 of the intermediate conduit 206. Further, auxiliary arm 282 may define a passage 284 therethrough and one or more apertures 286 defined therein and in fluid communication with the passage 284. A portion of the wash fluid may flow from the passage 240 into passage 284, rather than into passages 214, and may then be exhausted from the passage 284 through the apertures 286. Notably, in some embodiments, at least one aperture 286 may be defined proximate a tip 288 of the auxiliary arm 282, which may extend beyond the counterweight 280. The apertures 286 may, for example, have generally circular travel paths that supplement the travel paths of the apertures 216.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray arm assembly for a dishwasher appliance, the spray arm assembly comprising:

a spray arm comprising a plurality of branches connected to each other and arrayed about a center point, each of the plurality of branches defining a passage therethrough and an aperture in fluid communication with the passage, the center point defining a spray arm central axis, the spray arm rotatable about the spray arm central axis;

a base conduit defining a passage therethrough, the base conduit defining a base conduit central axis, the base conduit central axis offset from the spray arm central axis;

an intermediate conduit connecting the base conduit and the spray arm, the intermediate conduit defining a passage in fluid communication between the passage of the base conduit and the passages of the plurality of branches, the intermediate conduit rotatable about the base conduit central axis, the intermediate conduit comprising a first collar that defines a first opening and a second collar that defines a second opening, the first opening providing the fluid communication between the passage of the intermediate conduit and the passage of the base conduit, the second opening providing the fluid communication between the passage of the intermediate conduit and the passages of the plurality of branches;

a gear assembly at least partially disposed within the intermediate conduit, the gear assembly comprising a first gear rotatable about the base conduit central axis and a second gear rotatable about the spray arm central axis, the gear assembly further comprising a first hollow bearing extending from the first gear through the first opening and a second hollow bearing extending from the second gear through the second opening, wherein a radial clearance of between about 0.005 inches and about 0.020 inches is defined between the first hollow bearing and the first collar and between the second hollow bearing and the second collar; and a solid bearing disposed between the first gear or the second gear and a portion of the intermediate conduit, wherein the solid bearing comprises a body and a support post extending from the body.

2. The spray arm assembly of claim 1, wherein the gear assembly further comprises a third gear rotatably connecting the first gear and the second gear.

3. The spray arm assembly of claim 1, wherein a gear ratio between the first gear and the second gear is approximately 1 to −0.75.

4. The spray arm assembly of claim 1, wherein the first gear and the second gear are each hollow.

5. The spray arm assembly of claim 4, wherein openings are defined between teeth of the first gear and between teeth of the second gear, the openings allowing flow of wash fluid through the first gear and the second gear.

6. The spray arm assembly of claim 1, wherein the first collar and second collar each comprises a first inner sidewall, a second inner sidewall having a diameter less than a diameter of the first inner sidewall, and a step extending between the first inner sidewall and the second inner sidewall.

7. The spray arm assembly of claim 6, wherein the first hollow bearing and the second hollow bearing each comprise a body and a flange extending from the body, wherein the radial clearance of between about 0.005 inches and about 0.020 inches is defined between each body and associated second inner sidewall and between each flange and associated first inner sidewall.

8. The spray arm assembly of claim 1, wherein the intermediate conduit comprises an upper casing portion and a lower casing portion, wherein the solid bearing is a first solid bearing disposed between the first gear and the lower casing portion, and further comprising a second solid bearing disposed between the second gear and the upper casing portion.

9. The spray arm assembly of claim 8, wherein the first solid bearing and second solid bearing each comprise a body and a support post extending from the body.

10. The spray arm assembly of claim 9, wherein each support post has a diameter of between 0.1 inches and 0.15 inches.

11. The spray arm assembly of claim 9, wherein a pocket is defined in the upper casing portion and in the lower casing portion, and wherein the support post of the first solid bearing is positioned in the pocket of the lower casing portion and the support post of the second solid bearing is positioned in the pocket of the upper casing portion.

12. The spray arm assembly of claim 11, wherein a radial clearance of between about 0.005 inches and about 0.020 inches is defined between the support post of the first solid bearing and the pocket of the lower casing portion and between the support post of the second solid bearing and the pocket of the upper casing portion.

13. The spray arm assembly of claim 11, wherein an axial clearance of between about 0.005 inches and about 0.020 inches is defined between the support post of the first solid bearing and the pocket of the lower casing portion and between the support post of the second solid bearing and the pocket of the upper casing portion.

14. A spray arm assembly for a dishwasher appliance, the spray arm assembly comprising:

a spray arm comprising a plurality of branches connected to each other and arrayed about a center point, each of the plurality of branches defining a passage therethrough and an aperture in fluid communication with the passage, the center point defining a spray arm central axis, the spray arm rotatable about the spray arm central axis;

a base conduit defining a passage therethrough, the base conduit defining a base conduit central axis, the base conduit central axis offset from the spray arm central axis;

an intermediate conduit connecting the base conduit and the spray arm, the intermediate conduit defining a passage in fluid communication between the passage of the base conduit and the passages of the plurality of branches, the intermediate conduit rotatable about the base conduit central axis, the intermediate conduit comprising a first collar that defines a first opening and a second collar that defines a second opening, the first opening providing the fluid communication between the passage of the intermediate conduit and the passage of the base conduit, the second opening providing the fluid communication between the passage of the intermediate conduit and the passages of the plurality of branches; and a gear assembly at least partially disposed within the intermediate conduit, the gear assembly comprising a first gear rotatable about the base conduit central axis and a second gear rotatable about the spray arm central axis, the gear assembly further comprising a first hollow bearing extending from the first gear through the first opening and a second hollow bearing extending from the second gear through the second opening, wherein a radial clearance of between about 0.005 inches and about 0.020 inches is defined between the first hollow bearing and the first collar and between the second hollow bearing and the second collar, wherein the intermediate conduit comprises an upper casing portion and a lower casing portion, and further comprising a first solid bearing disposed between the first gear and the lower casing portion and a second solid bearing disposed between the second gear and the upper casing portion, and wherein the first solid bearing and second solid bearing each comprise a body and a support post extending from the body.

15. The spray arm assembly of claim 14, wherein the gear assembly further comprises a third gear rotatably connecting the first gear and the second gear.

16. The spray arm assembly of claim 14, wherein a gear ratio between the first gear and the second gear is approximately 1 to −0.75.

17. The spray arm assembly of claim 14, wherein the first gear and the second gear are each hollow.

18. The spray arm assembly of claim 17, wherein openings are defined between teeth of the first gear and between teeth of the second gear, the openings allowing flow of wash fluid through the first gear and the second gear.

19. The spray arm assembly of claim 14, wherein the first collar and second collar each comprises a first inner sidewall, a second inner sidewall having a diameter less than a diameter of the first inner sidewall, and a step extending between the first inner sidewall and the second inner sidewall.

20. The spray arm assembly of claim 14, wherein a pocket is defined in the upper casing portion and in the lower casing portion, and wherein the support post of the first solid bearing is positioned in the pocket of the lower casing portion and the support post of the second solid bearing is positioned in the pocket of the upper casing portion.

* * * * *